United States Patent [19]

Harris

[11] 4,146,122

[45] Mar. 27, 1979

[54] DISPENSING DEVICE HAVING A COIN OPERATED DOOR LOCK

[76] Inventor: Frank I. Harris, 1/27 Greenwich Rd., Greenwich, New South Wales, Australia

[21] Appl. No.: 855,515

[22] Filed: Nov. 28, 1977

[30] Foreign Application Priority Data

Dec. 14, 1976 [AU] Australia ..... PC8480

[51] Int. Cl.[2] ..... G07F 11/00

[52] U.S. Cl. ..... 194/57; 194/59; 221/194; 221/154

[58] Field of Search ..... 221/151, 152, 194, 289, 221/154; 194/57, 59

[56] References Cited

U.S. PATENT DOCUMENTS

| | | | |
|---|---|---|---|
| 2,252,493 | 8/1941 | Dennis | 221/152 |
| 2,376,960 | 5/1945 | Clem | 194/57 |
| 3,613,945 | 10/1971 | Rockola | 221/295 |
| 3,884,337 | 5/1975 | Voegeli | 194/59 |

*Primary Examiner*—Allen N. Knowles

*Attorney, Agent, or Firm*—Ladas, Parry, Von Gehr, Goldsmith & Deschamps

[57] ABSTRACT

A dispensing apparatus for installation in refrigerator or refrigeration units wherein said apparatus comprises a housing, a door slidably connected to said housing, a coin or token receiving opening in said housing and said door, a door unlocking mechanism adaped to be activated when a coin or token is inserted into said opening, a coin or token exit and a guard to prevent the removal of more than the permitted number of articles, said guard being adapted to cooperate with said door such that when said door is opened said guard closes off the dispensing compartment.

14 Claims, 7 Drawing Figures

DISPENSING DEVICE HAVING A COIN OPERATED DOOR LOCK

This invention relates to a dispensing device.

The advantages of vending machines are well known when the machine is utilized to dispense general articles. However, with other articles, especially bottled and canned beverages, problems arise due to the nature of the article. That is, these articles require refrigeration and as such the present vending machines for dispensing such articles are very large and bulky due to the mechanism used in dispensing these articles.

Further, since the cost of such articles as beverages is relatively expensive, the need for a large number of coins to operate the dispenser is impractical. To overcome this disadvantage, the device when used in certain circumstances could be adapted for operation by the use of tokens.

The device of the present application finds its particular application in public lodging places such as the individual rooms within a motel, hotel, offices, etc.

Accordingly, the device of the present application overcomes the above disadvantages by providing a dispensing means which is small, compact and readily installed into even the smallest refrigerators on any suitable premises, particularly as mentioned previously in motel and hotel rooms, offices, etc.

Broadly, the invention provides a dispensing means including a housing means, a door slidably connected to said housing, a coin or token receiving opening in said housing and said door, a door unlocking means adapted to be activated when a coin or token is inserted into said opening, a coin or token exit means and a guard means to prevent the removal of more than the permitted number of articles, said guard means being adapted to cooperate with said door such that when said door is opened said guard means closes off the dispensing compartment.

In another broad form the invention comprises an article dispensing apparatus comprising: a housing containing an article dispensing compartment a door member allowing access to said article dispensing compartment a coin or token receiving means located in said housing, a locking member located within said housing pivotally connected to said door member; a first stop means positioned such that said locking lever means is adapted to abut against said first stop means to prevent the door member being opened when said article dispensing apparatus is in its normal operational orientation; a second stop means located adjacent said first stop means so that said locking member is adapted to abut against said second stop means to prevent the door member being opened when said article dispensing apparatus is tilted from its normal operational orientation; and a guard means adapted to seal said article dispensing compartment to prevent the removal of more than the permitted number of articles when said door member is open, and adapted to allow entry of the desired number of articles into the dispensing compartment when said door member is closed; wherein upon insertion of a coin or token said locking member is positioned by said inserted coin or token, so that it does not abut against the first stop means during the opening of said door member thus allowing the door member to open and wherein said inserted token or coin, falls into a coin collection compartment thus preventing the door member from being moved in the opening direction until said door member is fully closed and a coin or token is again deposited in said coin or token receiving means.

The invention of the present application will now be described with reference to a preferred embodiment as illustrated in the accompanying drawings in which.

Figure 1:
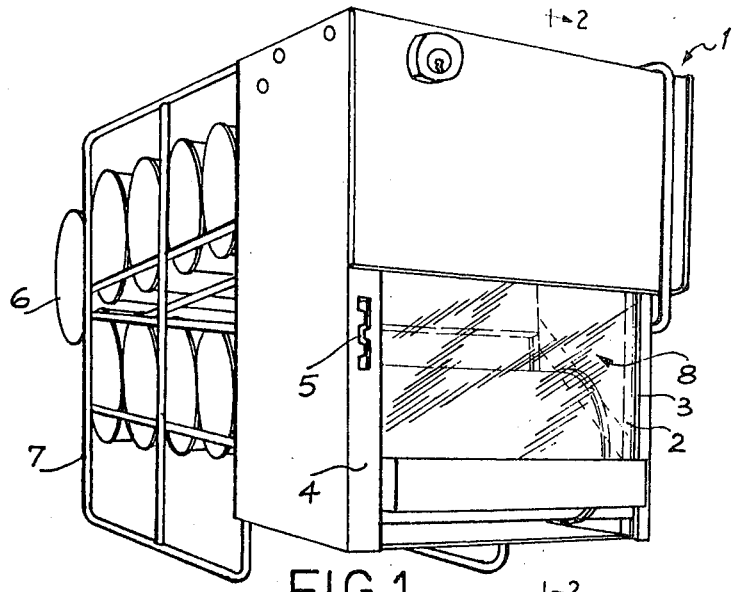
FIG. 1 shows a perspective view of an article dispensing apparatus made in accordance with one embodiment of the present invention.

In this embodiment as may be seen in the FIG. 1 there is provided a door 2 which is preferably made from a clear plastics such as PERSPEX. As such, the door also forms an article viewing window. The door is slidably maintained between a pair of channel sections 3 and 4. One of the said pair of channel sections 4 includes a slot 5 which is adapted to receive a coin or token. When in the closed position the door 2 has a corresponding slot which cooperates with the coin or token receiving slot 5 in the channel 4.

In this embodiment the article dispensing apparatus 1 is used to dispense cans which are stacked in zig-zag arrangement in the can supplier 7, so that the cans are moved by gravity down the two inclines of the can supplier 3 as a can moves into the article dispensing compartment 8. The article dispensing apparatus 1 is housed in a refrigeration unit (not shown), to keep the cans at the desired temperature.

Figure 2:
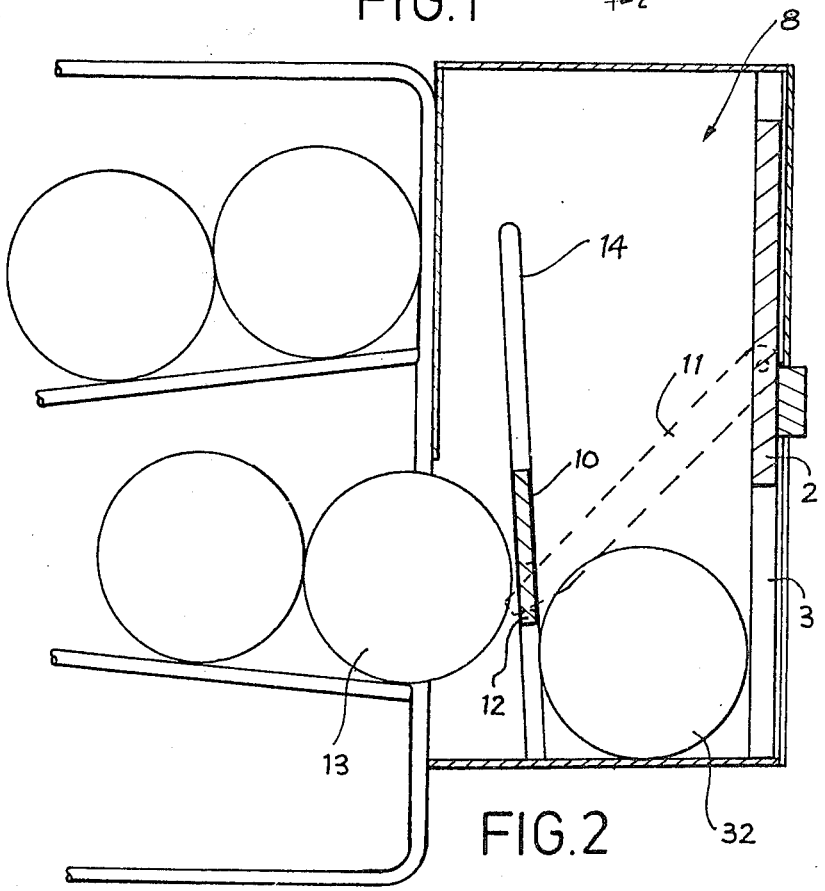
FIG. 2 shows a partial sectional view taken along the line 2—2 of FIG. 1.

The operations of one embodiment of the present invention will now be discussed with reference to FIGS. 2 to 5. In this embodiment the operation mechanism consists of four moving parts a substantially planar locking member 9, a door 2, guard means 10 and a lever 11 pivotally connected to the door means 2. The lever 11 passes through an opening 12 in the guard means 10, such that as the door 2 is opened the guard means 10 is lowered to prevent the can 13 from entering the article dispensing compartment 8, as shown in FIG. 2. The guard means 10 slides in a pair of oppositely positioned grooves 14. The locking member 9 is connected to the door 2 by pivot 15.

Figure 3:
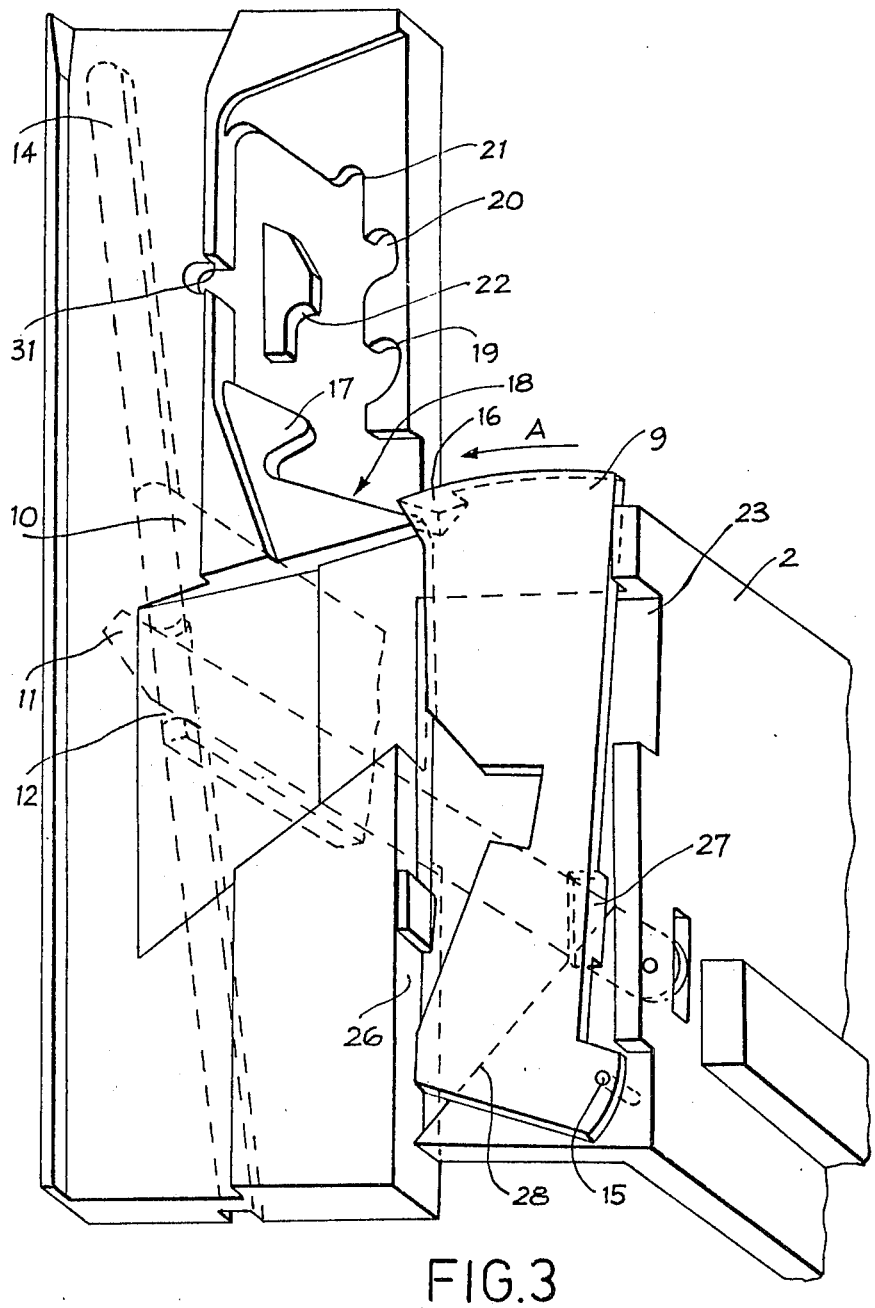
FIGS. 3 to 5 show the positions of the operating numbers of the abovementioned embodiment.
Figure 4:
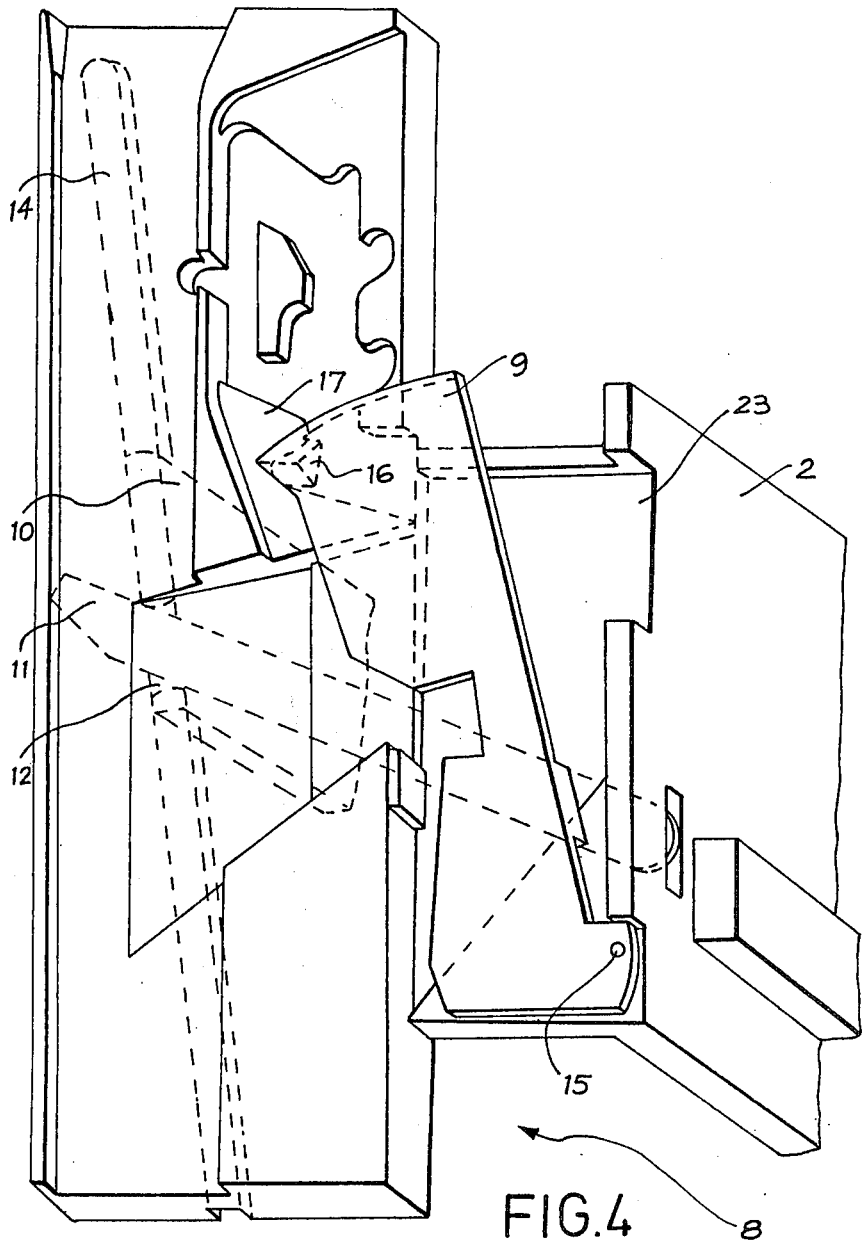

FIG. 3 shows the position of the various operation mechanisms when the door 2 is in the closed position. The locking member 9 is pivotally connected at pivot 15 such that due to the shape of the locking member 9, it tends to pivot in the direction of the arrow A. Thus if the door 2 is raised without a token being inserted in the apparatus the projection 16 of the locking member 9 slides up the inclined surface 18, and as shown in FIG. 4, abuts against a stop 17, thus preventing access to the article dispensing compartment 8.

Stops 19 to 22 are provided to prevent the door 2 being opened, if the apparatus tilted forward and shaken. The locking member 9 being so pivoted at 15 that if the apparatus is sufficiently tilted forward so that the projection 16 avoids the stop 17, the locking member 9 pivots in the direction of the front of the apparatus and abuts against the stop 19w. If the machine is rocked and the door 2 is juggled the stops 20 and 22 prevent the door 2 from being sufficiently opened to allow a can to be removed from the article dispensing compartment 8.

If a token or coin is inserted in the token or coin receiving slot it passes through an opening 23 and is blocked from falling into the token or coin slide 25 by a block 26 connected to the door 2. The token 24 rests between the surface of the locking member 9, the wall face 26 and the slide 28.

Figure 5:
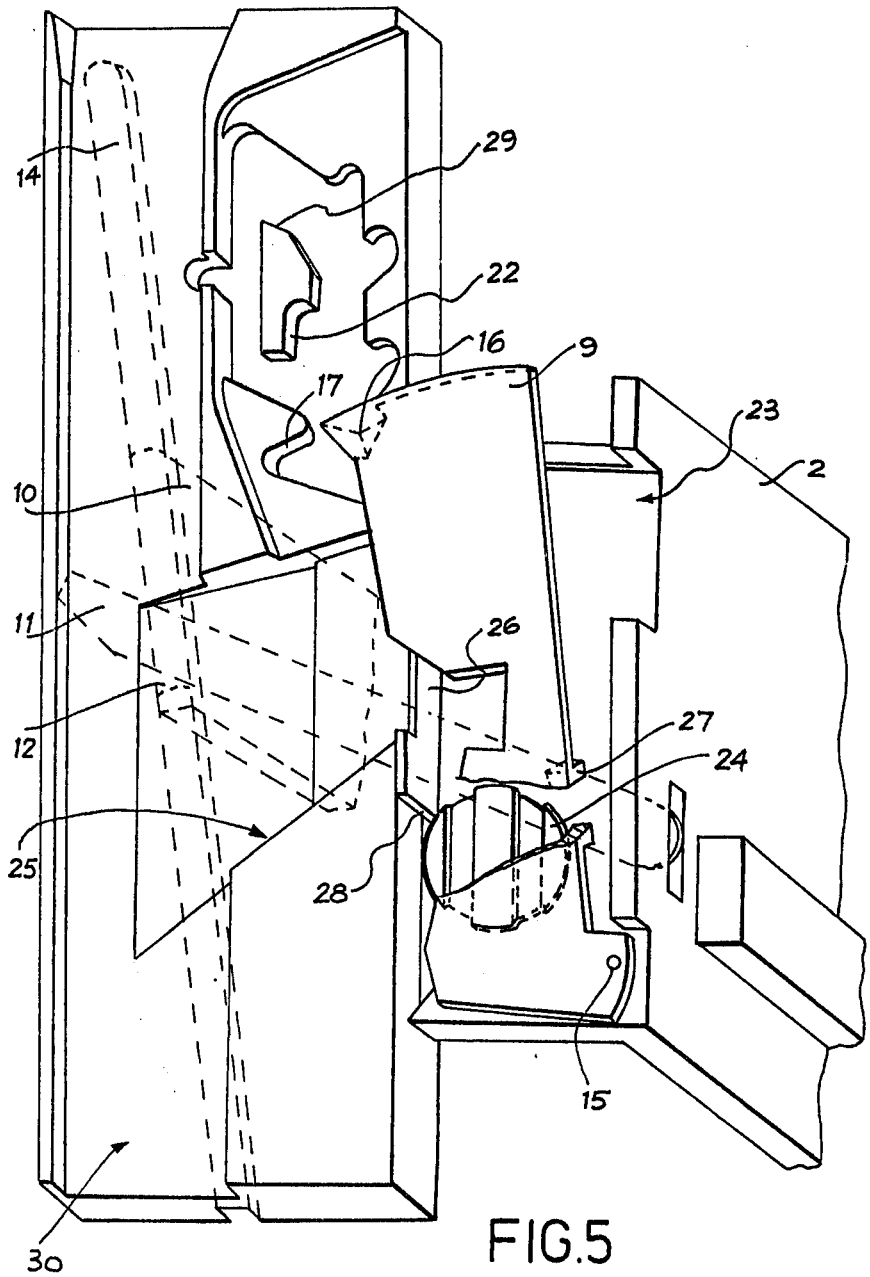

As the door 2 is raised the token 24, as shown in FIG. 5 abuts against the edge 28 of the block 26 and the projection 27 of the locking member 9 such that the projection 16 of the locking member 9 passes between the stops 17 and 22. As the projection 16 passes over the top 29 of the stop 22 the block 26 rises with the door such that the token 24 is free to fall down the slide 25, into the coin or token collection chute 30 token or coin holder.

The various stops 7, 19, 20, 21, 29, 31 again prevent the complete opening of the door 2 until the door 2 is closed and another coin or token is inserted into the apparatus.

When the door 2 is fully open the guard means 10 is positioned in its slot 14, as shown in FIG. 2, preventing the can 13 from entering the article dispensing compartment 8. While the door 2 is fully open to allow removal of can 32 from the article dispensing compartment 8. The can 13 cannot enter the article dispensing compartment 8 until the projection 16 has passed below stop 17 as the door 2 is being closed.

To make it more difficult to use counterfeit coins or washers one embodiment of the present invention utilises a token slot 5 having a varied cross-section, as shown in FIG. 1. This slot could be part of a separate insert which can be interchanged on other apparatus according to the present invention and replaced by insets having slots of different profiles.

Figure 6:
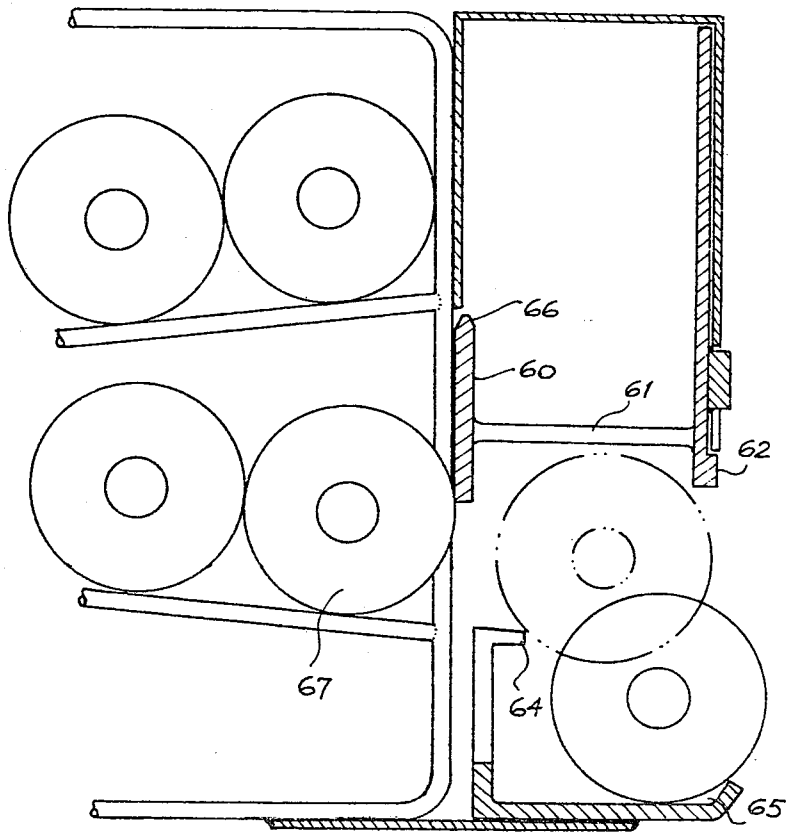
FIGS. 6 and 7 show the operation of another embodiment of the present invention.
Figure 7:
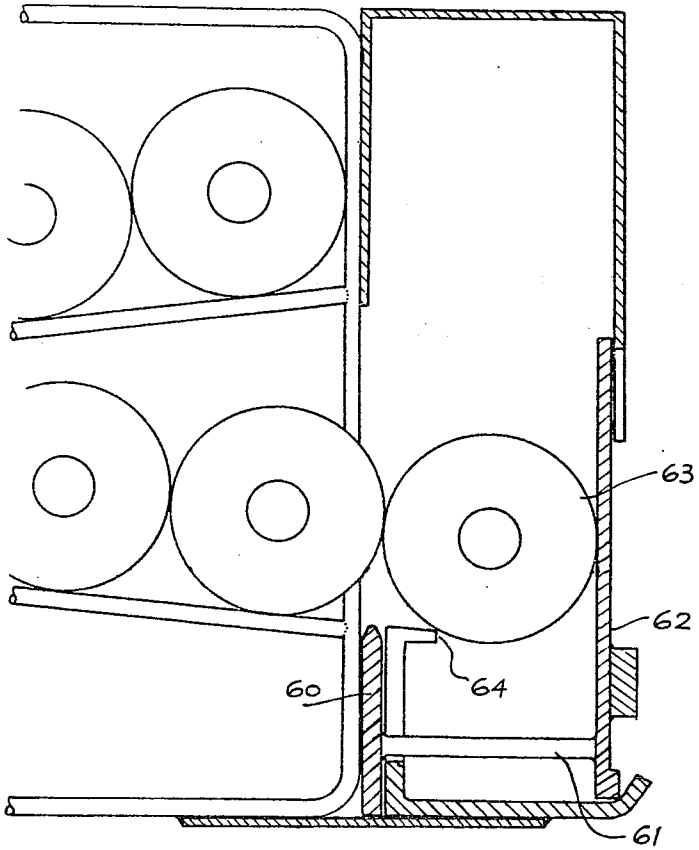

Another embodiment of the present invention is shown in FIGS. 6 and 7. The operating mechanism is the same as in FIGS. 3 to 5 except that the door 62 and guard means 60 are rigidly attached to each other by a member 61, such that the door 62 and the guard means 60 are raised or lowered as one unit. In this embodiment, which is shown dispensing bottles, has a bottle 63 in the bottle dispensing compartment 8 resting between the door 62 and a tip 64. As the door 62 is raised a gap, between the bottom of the door 62 and the tip 64 is formed, such that the bottle 63 (as shown in broken lines in FIG. 6) can pass therethrough and falls to the tray 65 where it can be removed from the dispensing apparatus. At the same time the guard means 60 which in this embodiment has a tapered leading edge 66, prevents the next bottle 67 from entering the article dispensing compartment.

It is also possible that the article dispensing apparatuses will be stacked one upon another while is used in a refrigeration unit such as a hotel refrigerator therefore each unit can have a coin chute 30 communicating with the unit below such that the tokens or coins will all fall into a common collection area.

It is a further embodiment of the present invention that more than one article at a time could be dispensed, such as two small bottles of whisky. The feeding of the articles to the dispenser can consist of a vertical feeder with a small incline at the end directing the articles into the article dispensing chamber. However any suitable feeder unit could be used without departing from the spirit of the invention.

What I claim is:

1. An article dispensing apparatus comprising: a housing containing an article dispensing compartment a door member allowing access to said article dispensing compartment a coin or token receiving means located in said housing, a locking member located within said housing pivotally connected to said door member; a first stop means positioned such that said locking lever means is adapted to abut against said first stop means to prevent the door member being opened when said article dispensing apparatus is in its normal operational orientation; a second stop means located adjacent said first stop means so that said locking member is adapted to abut against said second stop means to prevent the door member being opened when said article dispensing apparatus is tilted from its normal operational orientation; and a guard means adapted to block said article dispensing compartment to prevent the removal of more than the permitted number of articles when said door member is open, and adapted to allow entry of the desired number of articles into the dispensing compartment when said door member is closed; wherein upon insertion of a coin or token said locking member is positioned by said inserted coin or token, so that it does not abut against the first stop means during the opening of said door member thus allowing the door member to open and wherein said inserted token or coin, falls into a coin collection compartment thus preventing the door member from being moved in the opening direction until said door member is fully closed and a coin or token is again deposited in said coin or token receiving means.

2. An apparatus according to claim 1 wherein said housing has a pair of oppositely mounted channel sections in which said door member is slidably mounted, said door member having an article viewing member, and having a second lever member pivotally attached thereto, which slidably pivots on a fixed pivot mounted between said door member and said guard means which is slidably maintained within two oppositely mounted channel sections in said housing and wherein said second lever member extends through an opening in said guard member such that upon raising of said door member to allow access to said article dispensing compartment said second lever member lowers said guard means to seal said article dispensing compartment to prevent the removal of more than the permitted number of articles, and upon closing of said door member said second lever member raises said guard means to allow entry of the permitted number of articles into the article dispensing compartment.

3. An apparatus according to claim 2 wherein said locking member is substantially planar and slides between the housing and the first and second stop means, and has a projection, projecting substantially normal to the plane of the lever member which is adapted to abut against the first and second stop means when said article dispensing apparatus is respectively in its normal operational orientation and titled from its normal operational orientation.

4. An apparatus according to claim 2 wherein upon opening of said door member, said token or coin receiving means is blocked to prevent the insertion of another coin or token.

5. An apparatus according to claim 1 wherein said door member is slidably mounted in a pair of oppositely positioned channel sections mounted in the housing, said door member having an article viewing member, and being rigidly joined to the guard member by joining means, such that upon raising of said door member said guard member raises to seal said article dispensing compartment to prevent the removal of more than the permitted number of articles, and upon the closing of said door member said guard member lowers to allow entry of the permitted number of articles into the article dispensing compartment.

6. An apparatus according to claim 5 wherein said locking member is substantially planar and slides between the housing and the first and second stop means, and has a projection, projecting substantially normal to the plane of the lever member which is adapted to abut against the first and second stop means when said article dispensing apparatus is respectively in its normal operational orientation and tilted from its normal operational orientation.

7. An apparatus according to claim 6 wherein upon opening of said door member, said token or coin receiving means is blocked to prevent the insertion of another coin or token.

8. An article dispensing apparatus comprising: a housing containing an article dispensing compartment a door member allowing access to said article dispensing compartment a token receiving means located in said housing, said token receiving means has a receiving slot of varying width such that only a token of a given profile will operate said dispensing apparatus, a locking member located within said housing pivotally connected to said door member; a first stop means positioned such that said locking lever means is adapted to abut against said first stop means to prevent the door member being opened when said article dispensing apparatus is in its normal operational orientation; a second stop means located adjacent said first stop means so that said locking member is adapted to abut against said second stop means to prevent the door member being opened when said article dispensing apparatus is tilted from its normal operational orientation; and a guard means adapted to block said article dispensing compartment to prevent the removal of more than the permitted number of articles when said door member is open, and adapted to allow entry of the desired number of articles into the dispensing compartment when said door member is closed; wherein upon insertion of a coin or token said locking member is positioned by said inserted coin or token, so that it does not abut against the first stop means during the opening of said door member thus allowing the door member to open and wherein said inserted token or coin, falls into a coin collection compartment thus preventing the door member from being moved in the opening direction until said door member is fully closed and a coin or token is again deposited in said coin or token receiving means.

9. An apparatus according to claim 8 wherein said housing has a pair of oppositely mounted channel sections in which said door member is slidably mounted, said door member having an article viewing member, and having a second lever member pivotally attached thereto, which slidably pivots on a fixed pivot mounted between said door member and said guard means which is slidably maintained within two oppositely mounted channel sections in said housing and wherein said second lever member extends through an opening in said guard member such that upon raising of said door member to allow access to said article dispensing compartment said second lever member lowers said guard means to seal said article dispensing compartment to prevent the removal of more than the permitted number of articles, and upon closing of said door member said second lever member raises said guard means to allow entry of the permitted number of articles into the article dispensing compartment.

10. An apparatus according to claim 8 wherein said door member is slidably mounted in a pair of oppositely positioned channel sections mounted in the housing, said door member having an article viewing member, and being rigidly joined to the guard member by joining means, such that upon raising of said door member said guard member raises to seal said article dispensing compartment to prevent the removal of more than the permitted number of articles, and upon the closing of said door member said guard member lowers to allow entry of the permitted number of articles into the article dispensing compartment.

11. An apparatus according to claim 9 wherein said locking member is substantially planar and slides between the housing and the first and second stop means, and has a projection, projecting substantially normal to the plane of the lever member which is adapted to abut against the first and second stop means when said article dispensing apparatus is respectively in its normal operational orientation and tilted from its normal operational orientation.

12. An apparatus according to claim 11 wherein upon opening of said door member, said token or coin receiving means is blocked to prevent the insertion of another coin or token.

13. An apparatus according to claim 10 wherein said locking member is substantially planar and slides between the housing and the first and second stop means, and has a projection, projecting substantially normal to the plane of the lever member which is adapted to abut against the first and second stop means when said article dispensing apparatus is respectively in its normal operational orientation and tilted from its normal operational orientation.

14. An apparatus according to claim 13 wherein upon opening of said door member, said token or coin receiving means is blocked to prevent the insertion of another coin or token.

* * * * *